United States Patent [19]

Meurer et al.

[11] 4,149,396

[45] Apr. 17, 1979

[54] MANDREL HOLDING AND RELEASING MEANS

[75] Inventors: Hans Meurer; Klaus Rehag, both of Mönchen-Gladbach, Fed. Rep. of Germany

[73] Assignee: Wean United, Inc., Pittsburgh, Pa.

[21] Appl. No.: 858,048

[22] Filed: Dec. 6, 1977

[51] Int. Cl.[2] ..... B21B 25/06

[52] U.S. Cl. ..... 72/97; 72/209

[58] Field of Search ..... 72/97, 208, 209

[56] References Cited

U.S. PATENT DOCUMENTS

| | | | |
|---|---|---|---|
| 3,762,201 | 10/1973 | Schoenfeld et al. | 72/209 |
| 4,022,043 | 5/1977 | Chevet | 72/97 |

FOREIGN PATENT DOCUMENTS

| | | | |
|---|---|---|---|
| 2528308 | 12/1976 | Fed. Rep. of Germany | 72/97 |

*Primary Examiner*—Milton S. Mehr

*Attorney, Agent, or Firm*—Daniel Patch; Suzanne Kikel

[57] ABSTRACT

An arrangement for securing and easily releasing a mandrel from a mandrel rod upon their advancement and return movements during the piercing operation of a seamless tube. Between the mandrel and rod is an intermediate piece having one or more openings for receiving a hook with a nose extending into an opening of the mandrel. The hook is biased into position by a spring mounted around its one end and at its other end beneath a nose is a tapered surface for contacting a corresponding surface of the mandrel to pivot the hook away from the interior of the mandrel to release the mandrel from the intermediate piece and mandrel rod.

7 Claims, 2 Drawing Figures

MANDREL HOLDING AND RELEASING MEANS

The invention pertains to a detachable connection between a mandrel and a mandrel rod of a piercing mill for seamless tube, where an intermediate piece fits into the mandrel rod at the mandrel side, and where the rear surface of the mandrel rests against a ring-shaped surface of the intermediate piece. The mandrel, having a centrally located holding bored or machined opening is mounted on a corresponding centrally located projection of the intermediate piece, and at least one radially elastic hook is inserted into a radial opening of the intermediate piece. The elastic hook, under the force of a spring has a nose which engages beyond the external circumference of the projection of the intermediate piece into a ring-shaped radial recess of the holding opening.

The invention is based on a mandrel-mandrel rod connection known in the art as illustrated, for example, in DT-OS No. 25 14 720 corresponding to U.S. Pat. No. 4,022,043. In this case, the elastic hook is designed as a double hook. Its base is mounted to the intermediate piece by a bolt, and it has elastic protruding parts extending from the center of the intermediate piece which serve to release the hook from the outside. This means for releasing the hook allows the use of hooks with relatively hard spring action or high initial spring tension, which prevents an unintentional stripping of the mandrel during the return movement of the mandrel rod, but in addition, it also requires an external releasing device. Moreover, the mandrel rod must assume a specific radial position relative to the releasing device.

It is an object of the present invention to provide a mandrel-mandrel rod connection where, even with a high initial spring tension of the hook, the connection can be reliably released upon the backward movement of the mandrel rod simply by bringing the protruding part of the rear surface of the mandrel into contact with a retractable flap or a similar device having a surface which engages the surface of the mandrel to resist the backward movement of the mandrel rod. This arrangement prevents an overloading of the nose of the hook usually caused by a sudden hard impact.

More particularly, the present invention provides an elastic hook which can be moved forward axially against the effect of a pressure spring. As is generally the case with similar mandrel-mandrel rod connections, the rear holding surface of the holding part of the hook is slightly tapered, so that the hook can be pushed toward the inside of the intermediate piece to release the mandrel. When the mandrel is released, the hook can make a limited forward movement against the effect of the pressure spring, which avoids an overload of the hook. The holding part of the hook is always provided with a nose, whose contact surface pushes the holding part toward the inside when the mandrel is mounted. A preferred embodiment of the present invention provides a recess in axial extension of the tip of the nose which is tapered in the same direction as, and at an acute angle relative to, the axis of the mandrel rod, and that the distance of the tip of the nose from the frontal limitation is smaller than the axial displacement of the hook.

It is thus possible that the hook, moving forward against the effect of the pressure spring, runs against the tapered section of the recess and is automatically moved toward the inside. This makes it also possible to release the holding part of a hook whose rear surfaces are not tapered.

Another object of the present invention is to provide an arrangement having a radial recess in the intermediate piece which is contiguous to an axial bored opening which extends to the rear surface of the intermediate piece; a hook which is held in position in the axial opening with its thicker rear clamping part fitted into the axial opening; the thicker clamping part being tapered at the rear surface of the intermediate piece into a bolt of a smaller diameter; a setting nut fastened on the free threaded end of this bolt; a pressure spring clamped between the nut and a thrust washer resting on the front surface of the intermediate piece and contacting the thicker part of the clamping part. These elements are easy to manufacture and, moreover, this arrangement of elements offers the possibility to change the pressure spring and replace it with a spring of higher or lower initial tension. Moreover, all parts are protected when the mandrel is in place, and the ingress of scale which could affect the moveability of the parts is prevented.

Finally, it should be pointed out that the invention makes a three-point-mounting of the mandrel possible by providing three hooks evenly distributed over the circumference of the intermediate piece.

These objects, as well as other novel features and advantages of the present invention will be better understood and appreciated when the description of the invention is read along with the accompanying drawings of which:

Figure 1:
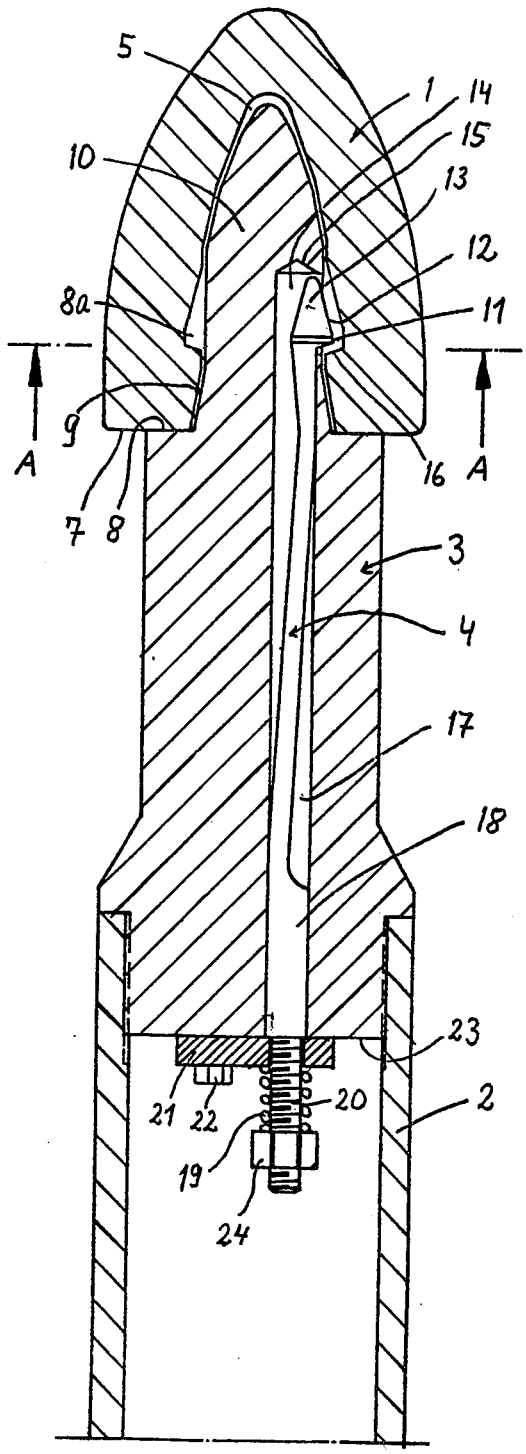
FIG. 1 is a longitudinal sectional view of the present invention.

FIG. 1 shows a detachable connection between a mandrel 1 and a hollow mandrel rod 2 of a seamless tube piercing mill, where an intermediate piece 3 having threads is screwed into the mandrel-end of the mandrel rod 2. The slightly protruding rear surface 7 of mandrel 1 is in contact with a ring-shaped surface 8 of intermediate piece 3. The mandrel, having a centrally located bored opening 5, is mounted on a correspondingly shaped centrally located projection 10 of intermediate piece 3. Furthermore, the holding opening 5 has a radial recess **8*a*, into which the holding part 11 of a hook 4 in radial recess 14** engages.

The recess 14 has a slanted surface front limitation 15 at an acute angle relative to the axis of the mandrel rod. Surface 15, upon operation of the present invention, is contacted by a surface 12 of a nose 13 provided at the holding part 11 of the hook 4. This contacting action causes nose 13 to move into the recess 14 at an acute angle relative to the axis of the mandrel rod. A conical shaped opening 9 of mandrel 1 permits projection 10 to enter opening 5 of the mandrel. The longitudinally-stretched hook 4 is located in an axial bored opening 17, into which radial recess 14 changes over. Hook 4 is held in axial opening 17 with its thicker rear clamping part 18 fitted into axial opening 17. Adjacent clamping part 18 at the rear surface 23 of intermediate piece 3 is a smaller diameter threaded portion in the form of a bolt 20, onto which a setting nut 24 is fastened to the free end of bolt 20.

A pressure spring 19 is clamped between nut 24 and a thrust washer 21, which abuts front surface 23 of intermediate piece 3, and clamping part 18, and which is secured to intermediate piece 3 by a screw 22.

Figure 2:
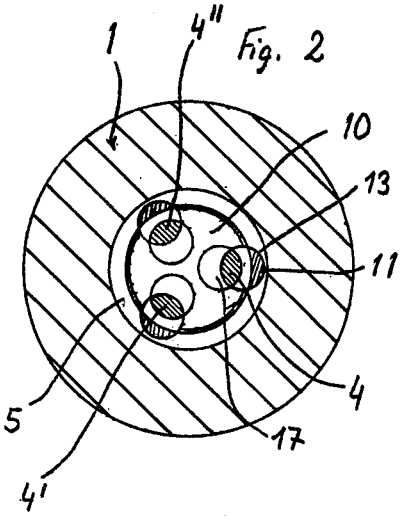
FIG. 2 is a transverse sectional view taken along lines A—A of FIG. 1.

FIG. 2 illustrates three hooks 4, 4', 4'', which are evenly distributed over the circumference of the intermediate piece 3.

After the piercing operation and upon the return motion of the mandrel-mandrel rod assembly, the slightly protruding part of the rear surface 7 of the mandrel impacts against an element not shown in the FIGURES, which the mandrel rod 2 with the intermediate piece 3 moves further backward. This continuing backward movement releases the conical seat 9 and brings a slanted ring surface 16 of the recess 8*a* into contact with the holding part 11 of the hook 4. After a short axial movement, surface 12 of nose 13 contacts the slanted surface limitation 15 of the recess 14. It slides along toward the inside thereby causing hook 4 to pivot inward so that the mandrel 1 can be removed and replaced.

In accordance with the provisions of the patent statutes, we have explained the principle and operation of our invention and have illustrated and described what we consider to represent the best embodiment thereof.

We claim:

1. A mandrel-mandrel rod assembly for a seamless tube piercing mill or the like comprising:

a mandrel rod having a hollow end at its mandrel end, a mandrel having an internal central opening extending from the rear toward the front and forming a rear surface, an intermediate piece mounted on said mandrel rod at its mandrel end, said intermediate piece including a centrally located projection at its mandrel end having surfaces for entering said opening of said mandrel to mount said mandrel on said intermediate piece, a surface on said intermediate piece for contacting said rear surface of said mandrel, first resilient energy exerting means mounted within said intermediate piece in a manner to allow relative movement therebetween and extending into said opening of said mandrel, second resilient energy exerting means associated with said first resilient means constructed and arranged in a manner to allow relative movement between said first resilient means and said intermediate piece assembly upon contact of said first resilient means with said mandrel, whereby said first resilient means automatically assumes a mandrel holding position and a mandrel releasing position on relative movement of said intermediate piece and said mandrel, and said first resilient means constructed and arranged within said intermediate piece and said mandrel in a manner that during said holding and releasing positions said first resilient means remains within a circumference formed inward of said projection of said intermediate piece.

2. An assembly according to claim 1 further comprising, a recess formed in said intermediate piece and a cooperative means formed in said mandrel for receiving a portion of said first resilient means during said mandrel releasing and mandrel holding positions.

3. An assembly according to claim 1 wherein said first resilient means includes at least three elastic hooks equidistantly located over the circumference of said intermediate piece.

4. An assembly according to claim 1 wherein said mandrel opening includes a ring-shaped radial recess, wherein said mounting means for said first resilient means includes a radial recess contiguous to a portion of said ring-shaped recess and, a third recess contiguous to said radial recess and located in front of said first resilient means, wherein said second resilient means includes means for axially urging and displacing said first resilient means in an axial direction to cause said mandrel to assume its holding position, wherein said first resilient means includes an elastic hook having a nose at its front end extending into said radial recesses for engaging a portion of said intermediate piece under the effect of said second resilient means, said nose having a portion protruding beyond the exterior of said projection of said intermediate piece into said ring-shaped recess.

5. An assembly according to claim 4 wherein said nose has a surface submerging into said ring-shaped recess at an acute angle relative to the axis of said mandrel rod, wherein said third recess, including a frontal limitation, has a surface tapered in the same general direction as said submerging surface and at an acute angle relative to said axis of said mandrel, said frontal limitation located a distance from the tip of said recess less than said axial displacement of said elastic hook.

6. An assembly according to claim 4 wherein said nose has an undersurface formed at an acute angle relative to the axis of said mandrel rod, and wherein said ring-shaped recess has a corresponding cooperative acute angle, whereby upon said relative movement of said intermediate piece and said mandrel, said nose is forced into said releasing position.

7. An assembly according to claim 4 wherein said mounting means for said first resilient means further includes, a centrally off-centered opening relative to said axis of said mandrel rod coaxially with said radial recess and extending substantially the length of said elastic hook and to the rear of said intermediate piece, and wherein said elastic hook further includes, a rear portion being of a larger cross section than a central portion thereof for fitting into said centrally off-centered opening, a reduced cross section portion contiguous to said rear portion and extending out of said intermediate piece and into said hollow end of said mandrel rod, and wherein said second resilient means includes a pressure spring mounted around said reduced portion and means carried by said reduced portion for adjusting said pressure spring.

* * * * *